US008807220B2

(12) United States Patent
Madison et al.

(10) Patent No.: US 8,807,220 B2
(45) Date of Patent: Aug. 19, 2014

(54) SIMULTANEOUS CONVERSION AND RECOVERY OF BITUMEN USING RF

(75) Inventors: Maxine Jones Madison, Houston, TX (US); Dwijen Kumar Banerjee, Owasoo, OK (US); Francis Eugene Parsche, Palm Bay, FL (US); Mark Alan Trautman, Melbourne, FL (US)

(73) Assignee: ConocoPhillips Company, Houston, TX (US)

( * ) Notice: Subject to any disclaimer, the term of this patent is extended or adjusted under 35 U.S.C. 154(b) by 379 days.

(21) Appl. No.: 13/233,548

(22) Filed: Sep. 15, 2011

(65) Prior Publication Data

US 2012/0090844 A1 Apr. 19, 2012

Related U.S. Application Data

(60) Provisional application No. 61/383,095, filed on Sep. 15, 2010, provisional application No. 61/466,359, filed on Mar. 22, 2011.

(51) Int. Cl.
*E21B 36/00* (2006.01)
*E21B 43/24* (2006.01)

(52) U.S. Cl.
CPC ..... *E21B 43/24* (2013.01)
USPC ..... 166/302; 166/57; 166/272.1; 208/402

(58) Field of Classification Search
CPC ..... E21B 43/24; E21B 36/00; E21B 36/04; E21B 43/2401
USPC ..... 166/302, 57, 272.1, 60; 208/402
See application file for complete search history.

(56) References Cited

U.S. PATENT DOCUMENTS

| | | | | |
|---|---|---|---|---|
| 2,634,961 | A | 4/1953 | Ljungstrom | |
| 2,795,279 | A | 6/1957 | Sarapuu | |
| 3,103,975 | A | 9/1963 | Hanson | |
| 3,696,866 | A | 10/1972 | Dryden | |
| 3,848,671 | A | 11/1974 | Kern | |
| 4,892,782 | A | 1/1990 | Fisher et al. | |
| 5,236,039 | A * | 8/1993 | Edelstein et al. | 166/248 |
| 5,378,879 | A | 1/1995 | Monovoukas | |
| 6,045,648 | A | 4/2000 | Palmgren et al. | |
| 6,348,679 | B1 | 2/2002 | Ryan et al. | |
| 6,649,888 | B2 | 11/2003 | Ryan et al. | |
| 8,365,823 | B2 | 2/2013 | Dreher | |
| 2007/0240880 | A1 * | 10/2007 | Olsen | 166/259 |
| 2010/0219107 | A1 * | 9/2010 | Parsche | 208/402 |

FOREIGN PATENT DOCUMENTS

WO PCT/US11/51755 9/2011

* cited by examiner

*Primary Examiner* — Yong-Suk (Philip) Ro
(74) *Attorney, Agent, or Firm* — ConocoPhillips Company

(57) ABSTRACT

The present invention provides a method of producing upgraded hydrocarbons in-situ from a production well. The method begins by operating a subsurface recovery of hydrocarbons with a production well. An RF absorbent material is heated by at least one RF emitter and used as a heated RF absorbent material, which in turn heats the hydrocarbons to be produced. Hydrocarbons are upgraded in-situ and then produced from the production well.

14 Claims, 3 Drawing Sheets

SIMULTANEOUS CONVERSION AND RECOVERY OF BITUMEN USING RF

PRIOR RELATED APPLICATIONS

This invention claims priority to U.S. Provisional No. 61/383,095, filed Sep. 15, 2010, and U.S. 61/466,359, filed on Mar. 22, 2011 each of which is incorporated by reference in its entirety herein.

FIELD OF THE INVENTION

The invention relates to a method and system for upgrading in situ the hydrocarbons to be produced, and more particularly to a method and system using radio frequency absorbent materials for in situ upgrading the hydrocarbons to be produced.

BACKGROUND OF THE INVENTION

Large scale commercial exploitation of certain oil sands and shale oil resources, available in huge deposits in Alberta and Venezuela, has been impeded by a number of problems, especially cost of extraction and environmental impact. The United States has tremendous coal resources, but deep mining techniques are hazardous and leave a large percentage of the deposits in the earth. Strip mining of coal involves environmental damage or expensive reclamation. Oil shale is also plentiful in the United States, but the cost of useful fuel recovery has been generally noncompetitive. The same is true for tar sands, which occur in vast amounts in Western Canada, which due to their viscosity are often not cost competitive to produce.

Materials such as oil shale, tar sands, and coal are amenable to in situ heat processing to produce gases and hydrocarbonaceous liquids. Generally, the heat develops the porosity, permeability and/or mobility necessary for recovery. Oil shale is a sedimentary rock which, upon pyrolysis or distillation, yields a condensable liquid, referred to as a shale oil, and non-condensable gaseous hydrocarbons. The condensable liquid may be refined into products that resemble petroleum products. Oil sand is an erratic mixture of sand, water and bitumen with the bitumen typically present as a film around water-enveloped sand particles. Using various types of heat processing the bitumen can, with difficulty, be separated from the sands. Also, as is well known, coal gas and other useful products can be obtained from coal using heat processing.

In the destructive distillation of oil shale or other solid or semi-solid hydrocarbonaceous materials, the solid material is heated to an appropriate temperature and the emitted products are recovered. This appears a simple enough goal but, in practice, the limited efficiency of the process has prevented achievement of large scale commercial application. Substantial energy is needed to heat the shale, and the efficiency of the heating process and the need for relatively uniform and rapid heating have been limiting factors on success. In the case of tar sands, the volume of material to be handled, as compared to the amount of recovered product, is again relatively large, since bitumen typically constitutes only about ten percent of the total weight. Material handling of tar sands is particularly difficult even under the best of conditions, and the problems of waste disposal contribute to cost inefficiencies.

There have been a number of prior proposals set forth for the upgrading of useful fuels from oil shales and tar sands in situ but, for various reasons, none has gained commercial acceptance and widespread application. One category of such techniques utilizes partial combustion of the hydrocarbonaceous deposits, but these techniques have generally suffered one or more of the following disadvantages: lack of precise control of the combustion, environmental pollution resulting from disposing of combustion products, and general inefficiency resulting from undesired combustion and waste of the resource.

Another category of proposed in situ upgrading techniques would utilize electrical energy for the heating of the formations. For example, in U.S. Pat. No. 2,634,961 there is described a technique wherein electrical heating elements are imbedded in pipes and the pipes are then inserted in an array of boreholes in oil shale. The pipes are heated to a relatively high temperature and eventually the heat conducts through the oil shale to achieve a pyrolysis thereof. Since oil shale is not a good conductor of heat, this technique is problematic in that the pipes must be heated to a considerably higher temperature than the temperature required for pyrolysis in order to avoid inordinately long processing times. However, overheating of some of the oil shale is inefficient in that it wastes input electrical energy, and may undesirably carbonize organic matter and decompose the rock matrix, thereby limiting the yield.

Further electrical in situ techniques have been termed as "ohmic ground heating" or "electrothermic" processes wherein the electric conductivity of the formations is relied upon to carry an electric current as between electrodes placed in separated boreholes. An example of this type of technique, as applied to tar sands, is described in U.S. Pat. No. 3,848,671. A problem with this technique is that the formations under consideration are generally not sufficiently conductive to facilitate the establishment of efficient uniform heating currents.

Variations of the electrothermic techniques are known as "electrolinking", "electrocarbonization", and "electrogasification" (see, for example, U.S. Pat. No. 2,795,279). In electrolinking or electrocarbonization, electric heating is again achieved via the inherent conductivity of the fuel bed. The electric current is applied such that a thin narrow fracture path is formed between the electrodes. Along this fracture path, pyrolyzed carbon forms a more highly conducting link between the boreholes in which the electrodes are implanted. Current is then passed through this link to cause electrical heating of the surrounding formations. In the electrogasification process, electrical heating through the formations is performed simultaneously with a blast of air or steam.

Generally, the just described techniques are limited in that only relatively narrow filament-like heating paths are formed between the electrodes. Since the formations are usually not particularly good conductors of heat, generally only non-uniform heating is achieved. The process tends to be slow and requires temperatures near the heating link that are substantially higher than the desired pyrolyzing temperatures, with the attendant inefficiencies previously described.

Another approach to in situ upgrading has been termed "electrofracturing". In one variation of this technique, described in U.S. Pat. No. 3,103,975, conduction through electrodes implanted in the formations is again utilized, the heating being intended, for example, to increase the size of fractures in a mineral bed. In another version, disclosed in U.S. Pat. No. 3,696,866, electricity is used to fracture a shale formation and a thin viscous molten fluid core is formed in the fracture. This core is then forced to flow out to the shale by injecting high pressured gas in one of the well bores in which an electrode is implanted, thereby establishing an open retorting channel.

Radio frequencies (RF) have been used in various industries for a number of years. Induction heating of certain RF absorbent materials has been shown to be an efficient heating method. The nature and suitability of RF heating depends on several factors. In general, most materials accept electromagnetic waves, but the degree to which RF heating occurs varies widely. RF heating is dependent on the frequency of the electromagnetic energy, intensity of the electromagnetic energy, proximity to the source of the electromagnetic energy, conductivity of the material to be heated, and whether the material to be heated is magnetic or non-magnetic. Pure hydrocarbon molecules are substantially nonconductive, of low dielectric loss factor and nearly zero magnetic moment.

RF absorbent materials, on the other hand, absorb RF readily and are heated. This increase in temperature can be attributed to two effects. Joule heating is due to ionic currents induced by the electric fields that are set up in the absorber. These ionic currents cause electrons to collide with molecules in the material and resistance heating results. The other effect is due to the interaction between polar molecules in the absorber and high frequency electric fields. The polar molecules begin to oscillate back and forth in an attempt to maintain proper alignment with the electric field. These oscillations are resisted by other forces and this vibratory resistance is converted into heat.

The RF part of the electromagnetic (EM) spectrum is generally defined as that part of the spectrum where electromagnetic waves have frequencies in the range of about 3 kilohertz (3 kHz) to 300 gigahertz (300 GHz). Microwaves are a specific category of radio waves that can be defined as radiofrequency energy where frequencies range from several hundred MHz to several GHz.

One common use of this type of energy is the household cooking appliance known as the microwave (MW) oven. Microwave radiation couples with, or is absorbed by, nonsymmetrical molecules or those that possess a dipole moment, such as water. In cooking applications, the microwaves are absorbed by water present in food and microwaves typically use a frequency of about 2.4 GHz for heating water. Free water vapor molecules, in contrast asborb in the 22 GHz range. Once the water absorbs the energy, the water molecules rotate and generate heat. The remainder of the food is then heated through a conductive heating process from the heated water molecules.

In general, the above described techniques are limited by the relatively low thermal and electrical conductivity of the bulk formations of interest. While individual conductive paths through the formations can be established, heat does not radiate at useful rates from these paths, and efficient heating of the overall bulk is difficult to achieve.

RF has been used for downhole upgrading, see e.g., US20060180304. However, in US20060180304 the EM energy is used to directly heat the oil components once the connate water has evaporated off. With direct heating of oil, it is said to be possible to control the temperature and avoid overheating carbonization effects.

US20100294489 by some of the same inventors as the instant invention, is similar to the work described herein. However, that work employs microwaves in the Ghz range, not radio waves, and thus has higher energy requirements than described herein.

Thus, what is needed in the art are more cost effective methods of using RF energies to produce heavy oils.

SUMMARY OF THE INVENTION

To upgrade the hydrocarbons in situ, the present invention proposes a method of heating the hydrocarbons by using a RF absorbent material placed at or near the production well. The RF absorbent material is first heated by the RF energy emitted by a RF emitter. The heated RF absorbent material in turn heats the hydrocarbons surrounding it, thereby upgrading the hydrocarbons to be produced.

Consequently, the present invention provides a method of producing upgraded hydrocarbons in-situ from a production well. The method begins by operating a subsurface recovery of bitumen with a production well. A radio frequency (RF) absorbent material is heated and used as a heated RF absorbent material. Hydrocarbons are upgraded in-situ and are then produced from the production well. The well then produces upgraded hydrocarbons from the production well.

The present invention also provides a system with a production well and a heated RF absorbent material that is heated by a RF emitter. In this system the heated RF absorbent material in-situ upgrades the hydrocarbons produced from the production well.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The following abbreviations are used herein:

| | |
|---|---|
| MW | Microwave |
| RF | Radio frequency |
| CSS | Cyclic steam stimulation |
| SAGD | Steam assisted gravity drainage |
| VAPEX | Vapor extraction process |
| THAI | Toe to heel air injection |
| COGD | Combustion overhead gravity drainage |

As used herein "RF absorbent material" is defined as any material that absorbs electromagnetic energy and transforms it to heat. In some literature RF absorbent materials are also called a "susceptor" material. RF absorbent materials have been suggested for applications such as microwave food packing, thin-films, thermosetting adhesives, RF-absorbing polymers, and heat-shrinkable tubing. Examples of RF absorbent materials are disclosed in U.S. Pat. No. 5,378,879; U.S. Pat. No. 6,649,888; U.S. Pat. No. 6,045,648; U.S. Pat. No. 6,348,679; and U.S. Pat. No. 4,892,782, which are incorporated by reference herein.

DESCRIPTION OF EMBODIMENTS OF THE INVENTION

Figure 1:
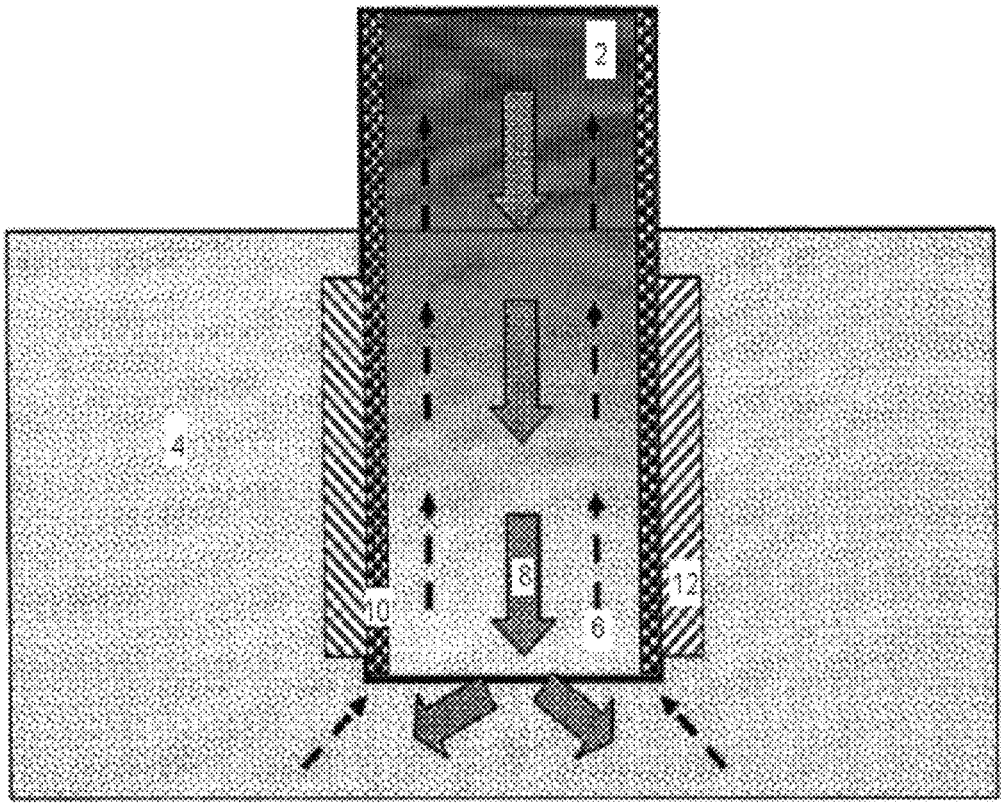
FIG. 1 depicts one embodiment of utilizing the RF absorbent material.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment discloses a method of producing upgraded hydrocarbons in-situ from a production well. The method begins by operating a subsurface recovery of bitumen with a production well. An RF absorbent material is heated and used as a heated RF absorbent material to upgrade heavy oils in situ. Hydrocarbons are then produced from the production well.

The method can be used as an enhanced oil recovery technique in any situation where hydrocarbons are produced from the subsurface with a production well. Examples where the present method can be used include cyclic steam stimulation (CSS), steam assisted gravity drainage (SAGD), vapor extraction process (VAPEX), toe to heel air injection (THAI) or combustion overhead gravity drainage (COGD). In all these processes there exists a need to upgrade the bitumen in-situ.

The RF absorbent material can be made from any conventionally known RF absorbent material capable of being heated with an RF emitter. Examples of types of RF absorbent materials include graphite, activated carbon, metal, metal oxides, metal sulfides, alcohols and ketones, particularly heavy alcohols, chloroprene and combinations of these materials.

The RF absorbent material can be provided as a powder, particle, granular substance, flakes, fibers, beads, chips, colloidal suspension, or in any other suitable form. When the RF absorbent material is provided as particles, the average volume of the particles can be less than about 10 cubic mm. For example, the average volume of the particles can be less than about 5 cubic mm, 1 cubic mm, or 0.5 cubic mm. Alternatively, the average volume of the RF absorbent particles can be less than about 0.1 cubic mm, 0.01 cubic mm, or 0.001 cubic mm. For example, the RF absorbent particles can be nanoparticles with an average particle volume from $1\times10^{-9}$ cubic mm to $1\times10^{-6}$ cubic mm, $1\times10^{-7}$ cubic mm, or $1\times10^{-8}$ cubic mm.

Depending on the preferred RF heating mode, the RF absorbent material can comprise conductive materials, magnetic materials, or polar materials. Exemplary conductive particles include metal, powdered iron (pentacarbonyl E iron), iron oxide, or powdered graphite. Exemplary magnetic materials include ferromagnetic materials include iron, nickel, cobalt, iron alloys, nickel alloys, cobalt alloys, and steel, or ferrimagnetic materials such as magnetite, nickel-zinc ferrite, manganese-zinc ferrite, and copper-zinc ferrite. Exemplary polar materials include butyl rubber (such as ground tires), barium titanate powder, aluminum oxide powder, or PVC flour.

In one exemplary embodiment, RF energy can be applied in a manner that causes the RF absorbent material to heat by induction. Induction heating involves applying an RF field to electrically conducting materials to create electromagnetic induction. An eddy current is created when an electrically conducting material is exposed to a changing magnetic field due to relative motion of the field source and conductor; or due to variations of the field with time. This can cause a circulating flow or current of electrons within the conductor. These circulating eddies of current create electromagnets with magnetic fields that opposes the change of the magnetic field according to Lenz's law. These eddy currents generate heat. The degree of heat generated in turn, depends on the strength of the RF field, the electrical conductivity of the heated material, and the change rate of the RF field. There can be also a relationship between the frequency of the RF field and the depth to which it penetrate the material, but in general, higher RF frequencies generate a higher heat rate.

The RF source used for induction RF heating can be for example a loop antenna or magnetic near-field applicator suitable for generation of a magnetic field. The RF source typically comprises an electromagnet through which a high-frequency alternating current (AC) is passed. For example, the RF source can comprise an induction heating coil, a chamber or container containing a loop antenna, or a magnetic near-field applicator. The exemplary RF frequency for induction RF heating can be from about 50 Hz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW.

In another exemplary embodiment, RF energy can be applied in a manner that causes the RF absorbent material to heat by magnetic moment heating, also known as hysteresis heating. Magnetic moment heating is a form of induction RF heating, whereby heat is generated by a magnetic material. Applying a magnetic field to a magnetic material induces electron spin realignment, which results in heat generation. Magnetic materials are easier to induction heat than non-magnetic materials, because magnetic materials resist the rapidly changing magnetic fields of the RF source.

Magnetic moment RF heating can be performed using magnetic susceptor particles. Exemplary susceptors for magnetic moment RF heating include ferromagnetic materials or ferrimagnetic materials. Exemplary ferromagnetic materials include iron, nickel, cobalt, iron alloys, nickel alloys, cobalt alloys, and steel. Exemplary ferrimagnetic materials include magnetite, nickel-zinc ferrite, manganese-zinc ferrite, and copper-zinc ferrite.

In certain embodiments, the RF source used for magnetic moment RF heating can be the same as that used for induction heating—a loop antenna or magnetic near-field applicator suitable for generation of a magnetic field, such as an induction heating coil, a chamber or container containing a loop antenna, or a magnetic near-field applicator. The exemplary RF frequency for magnetic moment RF heating can be from about 100 kHz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW.

In another embodiment, the RF energy source and RF absorbent material selected can result in dielectric heating. Dielectric heating involves the heating of electrically insulating materials by dielectric loss. Voltage across a dielectric material causes energy to be dissipated as the molecules attempt to line up with the continuously changing electric field.

Dielectric RF heating can be for example performed using polar, non-conductive susceptor particles. Exemplary susceptors for dielectric heating include butyl rubber (such as ground tires), barium titanate, aluminum oxide, or PVC. Water can also be used as a dielectric RF susceptor, but due to environmental, cost, and processing concerns, in certain embodiments it may be desirable to limit or even exclude water in processing of petroleum ore.

Dielectric RF heating typically utilizes higher RF frequencies than those used for induction RF heating. At frequencies above 100 MHz an electromagnetic wave can be launched from a small dimension emitter and conveyed through space. The material to be heated can therefore be placed in the path of the waves, without a need for electrical contacts. For example, domestic microwave ovens principally operate through dielectric heating, whereby the RF frequency applied is about 2.45 GHz.

The RF source used for dielectric RF heating can be for example a dipole antenna or electric near field applicator. An exemplary RF frequency for dielectric RF heating can be from about 100 MHz to about 3 GHz. Alternatively, the RF frequency can be from about 500 MHz to about 3 GHz. Alternatively, the RF frequency can be from about 2 GHz to about 3 GHz.

The power of the RF energy, as radiated from the RF source, can be for example from about 100 KW to about 2.5 MW, alternatively from about 500 KW to about 1 MW, and alternatively, about 1 MW to about 2.5 MW based upon the well length. One metric is from 1-25 KW per meter of well length for example.

The RF emitter can be disposed in any location capable of emitting RF frequencies to the RF absorbent material. Examples of locations the RF emitter can be placed include next to the RF absorbent material, above ground, below ground, adjacent to the RF absorbent material, or even to parallel the RF absorbent material. Likewise the RF antennas for the RF emitter can be placed anywhere as long as it is capable of heating the RF absorbent material. Examples of locations the RF antenna can be placed include next to the RF absorbent material, above ground, below ground, adjacent to the RF absorbent material, or even parallel to the RF absorbent material.

In one embodiment the RF emitter is calibrated so that the RF frequencies emitted are specific to the type of RF absorbent material used to achieve maximum heating capabilities. When this method is utilized different RF frequencies can be emitted to provide differing temperatures of the RF absorbent material based upon the amount of upgrading the hydrocarbons require.

In one embodiment the heated RF absorbent material can achieve a temperature ranging from 315° C. to 650° C. or even 425° C. to 535° C. The temperature range of the heated RF absorbent well will be adjusted so that maximum upgrading of the hydrocarbons can occur.

A primary advantage of using an RF transducer is that the electro-magnetic energy heats the absorbent material volumetrically as opposed to electrically resistive heating methods that heat by contact. The former heating method minimizes the temperature gradient across the RF absorbent material whereas that latter method may induce a larger temperature gradient across the material for the same delivered power. Thus the RF method limits the maximum temperature within the absorbent material for a prescribed average upgrading temperature compared to other heating methods. The implication is that downhole hardware such as liner or tubing will have a longer operating life without temperature induced failure. The RF frequency of operation may be selected to limit the peak temperatures on the installed hardware since the penetration or skin depth of the RF energy is inversely related to the applied frequency at the RF transducer.

The RF absorbent materials may be ionic salts, such as, for example, potassium chloride KC to provide ions to dissipate the RF wave energies. The dielectric constant of KC is near 5.9 and it has a dissipation factor of 0.002. Frequencies in the range of 10 to 100 GHz may be used.

In another embodiment the RF absorbent material is an ester. A preferred ester is ethyl carbamate $C_3H_7NO_2$. With ethyl carbamate radio waves at frequencies in the range of 100 to 10000 MHz may be used to produce RF heating although any frequency may be used when it is capable of producing heat. The polarization of the RF energy may orient to match that of the ester molecules such that maximum heating is obtained. The RF energy may also be unpolarized or even bipolarized.

The RF emitter may include an RF antenna, an RF transducer, or an RF wave generator. Radio frequency energy is transduced by the RF emitter in order to reach the RF absorbent material. The RF emitter can be conductive material such as iron, steel, or zinc.

The following examples are illustrative only, and are not intended to unduly limit the scope of the invention.

Example 1

RF Absorbent Material as Liner

FIG. 1 depicts one embodiment of the method/system wherein a production well 2 is disposed within a reservoir 4 for hydrocarbon 6 recovery. In this embodiment the method is used in a CSS/SAGD operation, henceforth steam 8 is shown to be injected downhole. FIG. 1 depicts the RF absorbent material 10 is used to line the vertical well. This permits the hydrocarbons 6 produced to contact the heated RF absorbent material 10 and be upgraded. The RF antenna 12 is shown in this embodiment to be parallel against the RF absorbent material 10.

Example 2

RF Absorbent Material at the Center of the Production Well

Figure 2:
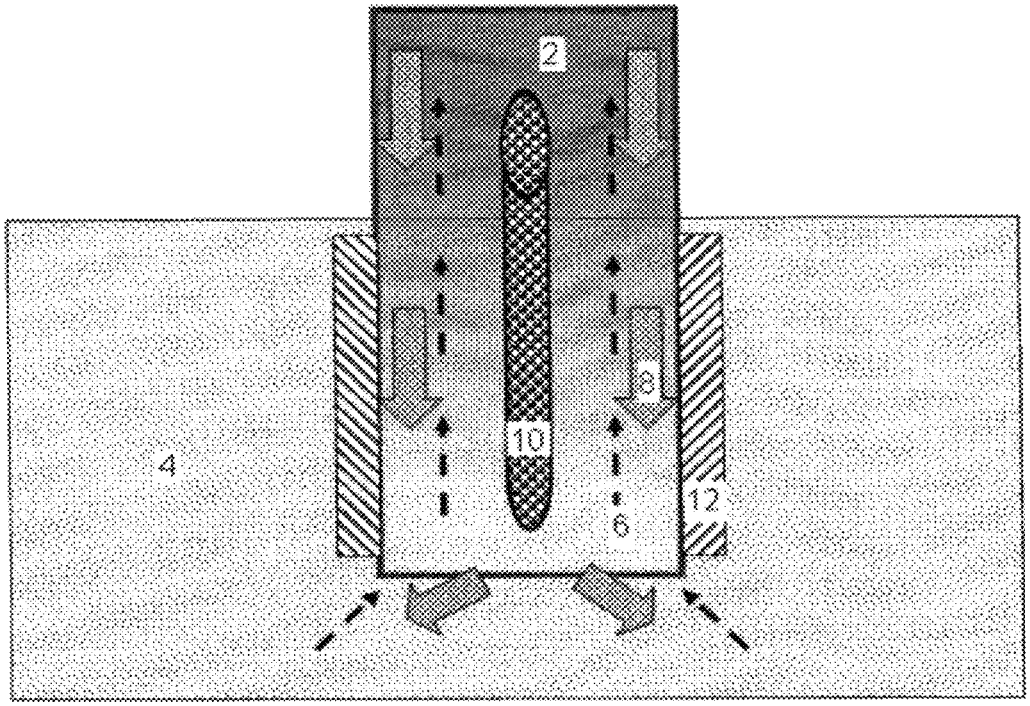
FIG. 2 depicts one embodiment of utilizing the RF absorbent material.

FIG. 2 depicts another embodiment of the method/system wherein a production well 2 is disposed within a reservoir 4 for hydrocarbon 6 recovery. In this embodiment the method is used in a CSS/SAGD operation, henceforth steam 8 is shown to be injected downhole. FIG. 2 depicts the RF absorbent material 10 as a rod placed in the center of the production well. This permits the hydrocarbons 6 produced to contact the heated RF absorbent material 10 and be upgraded. One distinctive feature of this embodiment is that the RF absorbent material 10 can be easily replaced, as one would simply extract the RF absorbent material rod from the center of the production well. The RF antenna 12 is shown in this embodiment to be along the outer wall of the production well 2.

Example 3

RF Absorbent Material a Pellets in the Hydrocarbons

Figure 3:
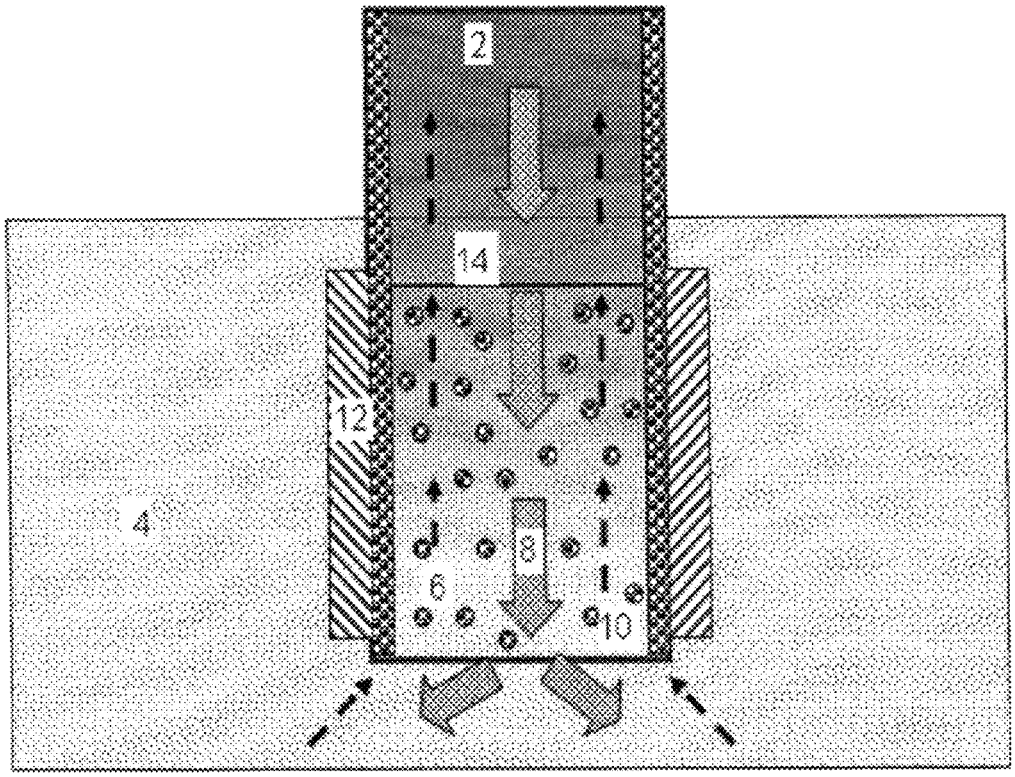
FIG. 3 depicts one embodiment of utilizing the RF absorbent material.

FIG. 3 depicts another embodiment of the method/system wherein a production well 2 is disposed within a reservoir 4 for hydrocarbon 6 recovery. In this embodiment the method is used in a CSS/SAGD operation, henceforth steam 8 is shown to be injected downhole. FIG. 3 depicts the RF absorbent material 10 as pellets dispersed throughout the hydrocarbons. In this method a membrane 14 can be utilized to restrict the flow of the RF absorbent material 10 into the processing of the hydrocarbons 6. This permits the hydrocarbons 6 produced to be contacted with the heated RF absorbent material 10 with a greater surface area and be upgraded. The RF antenna 12 is shown in this embodiment to be along the outer wall of the production well 2.

While the above three mentioned figures each depict differing ways of incorporating the method into a production well it should be noted that it is possible to combine two or more of the methods to improve the in situ upgrading of the hydrocarbons. For example, it is possible to both utilize a RF absorbent material as a liner for the production well and as pellets dispersed throughout the hydrocarbons, or a combination of all three permutations where the RF absorbent material is placed as a rod in the center of the production well, dispersed throughout the hydrocarbons and used to line the production well.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The following references are incorporated by reference in their entirety.

1. U.S. Pat. No. 5,378,879
2. U.S. Pat. No. 6,649,888
3. U.S. Pat. No. 6,045,648
4. U.S. Pat. No. 6,348,679
5. U.S. Pat. No. 4,892,782
6. US20100219107
7. U.S. Pat. No. 2,634,961
8. U.S. Pat. No. 3,858,671
9. U.S. Pat. No. 2,795,279
10. U.S. Pat. No. 3,103,975
11. U.S. Pat. No. 3,696,866

What is claimed is:

1. A method of enhancing in situ upgrading hydrocarbon in a hydrocarbon formation, comprising:

a) providing a production well for recovery of a subsurface hydrocarbon;

b) providing an RF (radio frequency) absorbent material rod in the center of said production well and in said subsurface hydrocarbon;

c) positioning a RF antenna along an outer wall of said production well;

c) heating said RF absorbent material with RF of 50 Hz to 100 MHz to generate a heated RF absorbent material and a heated and upgraded subsurface hydrocarbons in situ; and d) producing said heated and upgraded hydrocarbon from the production well.

2. The method of claim 1, wherein the temperature of the heated RF absorbent material ranges from 315 to 650° C.

3. The method of claim 1, wherein the RF absorbent material is selected from the group consisting of: chlorophene, metal, metal sulfides, graphite, activated carbon and combinations thereof, wherein metal is selected from the group consisting of powdered iron, iron oxide, nickel, cobalt, iron alloys, nickel alloys, cobalt alloys, steel, magnetite, nickel-zinc ferrite, manganese-zinc ferrite, and copper-zinc ferrite.

4. The method of claim 1, wherein an RF emitter is used to heat the RF absorbent material to produce the heated RF absorbent material.

5. The method of claim 4, wherein the RF emitter emits radio frequency waves at a power ranges from 100 KW to 2.5 MW (mega watts).

6. The method of claim 4, wherein the RF emitter is placed at the outside wall of the production well.

7. The method of claim 4, wherein the RF emitter emits radio frequency waves at frequencies ranging from 50 Hz to 3 GHz.

8. A system of enhancing in situ upgrading hydrocarbon in a hydrocarbon formation, comprising:

a production well;

a heated RF absorbent material rod in the center of said production well; and a RF emitter positioned along an outer wall of the production well that can emit RF waves at 50 Hz to 100 MHz;

wherein the heated RF absorbent material rod upgrades in situ the hydrocarbons produced from the production well.

9. The system of claim 8, wherein the production well produces heavy oil.

10. The system of claim 8, wherein the RF absorbent material is selected from the group consisting of: metal, metal sulfides, graphite, activated carbon and combinations thereof, wherein metal is selected from the group consisting of powdered iron, iron oxide, nickel, cobalt, iron alloys, nickel alloys, cobalt alloys, steel, magnetite, nickel-zinc ferrite, manganese-zinc ferrite, and copper-zinc ferrite.

11. The system of claim 8, wherein the temperature of the heated RF absorbent material ranges from 315° C. to 650° C.

12. The system of claim 8, wherein the RF emitter emits radio frequency waves at a power ranges from 100 KW to 2.5 MW.

13. The system of claim 8, wherein the RF emitter is placed at the outside wall of the production well.

14. The method of claim 8, wherein the RF emitter emits radio frequency waves at frequencies ranging from 50 Hz to 3 GHz.

* * * * *

UNITED STATES PATENT AND TRADEMARK OFFICE

CERTIFICATE OF CORRECTION

PATENT NO. : 8,807,220 B2
APPLICATION NO. : 13/233548
DATED : August 19, 2014
INVENTOR(S) : Madison et al.

It is certified that error appears in the above-identified patent and that said Letters Patent is hereby corrected as shown below:

On the title page item [73], should read

ConocoPhillips Company, Houston, TX (US)
Harris Corporation, Melbourne, FL (US)

Signed and Sealed this
Fifteenth Day of September, 2015

Michelle K. Lee

Michelle K. Lee
*Director of the United States Patent and Trademark Office*